US006810956B1

(12) United States Patent
Sandström

(10) Patent No.: US 6,810,956 B1
(45) Date of Patent: Nov. 2, 2004

(54) THREAD COUPLING FOR A DRILL STRING FOR PERCUSSIVE ROCK DRILLING

(75) Inventor: Roger Sandström, Fagersta (SE)

(73) Assignee: Uniroc AB, Fagersta (SE)

( * ) Notice: Subject to any disclaimer, the term of this patent is extended or adjusted under 35 U.S.C. 154(b) by 50 days.

(21) Appl. No.: 09/806,220

(22) PCT Filed: Sep. 22, 1999

(86) PCT No.: PCT/SE99/01652

§ 371 (c)(1),
(2), (4) Date: May 14, 2001

(87) PCT Pub. No.: WO00/19056

PCT Pub. Date: Apr. 6, 2000

(30) Foreign Application Priority Data

Sep. 28, 1998 (SE) ..... 9803267

(51) Int. Cl.[7] ..... E21B 17/042; F16D 1/00; F16L 15/06

(52) U.S. Cl. ..... 166/242.6; 175/323; 403/307; 403/343; 411/414; 411/416

(58) Field of Search ..... 166/300, 242.1, 166/242.6; 175/323; 285/370; 411/411, 414, 416, 379, 382, 366, 436; 403/307, 342, 343

(56) References Cited

U.S. PATENT DOCUMENTS

| | | | | | |
|---|---|---|---|---|---|
| 2,909,380 | A | * | 10/1959 | Hoye et al. | 285/333 |
| 3,586,353 | A | * | 6/1971 | Lorenz et al. | 403/343 |
| 3,645,570 | A | * | 2/1972 | Johansson et al. | 430/343 |
| 3,933,210 | A | | 1/1976 | Skidmore | |
| 4,004,832 | A | * | 1/1977 | Connelly | 285/333 |
| 4,040,756 | A | * | 8/1977 | Donegan | 403/307 |
| 4,295,751 | A | * | 10/1981 | Holmberg | 403/307 |
| 4,549,754 | A | * | 10/1985 | Saunders et al. | 285/334 |
| 4,570,982 | A | * | 2/1986 | Blose et al. | 285/334 |
| 4,582,348 | A | * | 4/1986 | Dearden et al. | 411/413 |
| 4,629,223 | A | * | 12/1986 | Dearden et al. | 285/334 |
| 4,687,368 | A | * | 8/1987 | Eklof et al. | 403/343 |
| 4,717,183 | A | * | 1/1988 | Nobileau | 285/334 |
| 4,760,887 | A | * | 8/1988 | Jansson et al. | 173/132 |
| 4,770,259 | A | * | 9/1988 | Jansson | 175/258 |
| 4,861,209 | A | | 8/1989 | Larsson | |
| 4,968,068 | A | * | 11/1990 | Larsson L. Kenneth | 403/343 |
| 4,969,671 | A | * | 11/1990 | Gross et al. | 285/333 |
| 5,427,418 | A | * | 6/1995 | Watts | 285/333 |
| 5,785,360 | A | * | 7/1998 | Nordfeldt et al. | 403/343 |
| 5,788,401 | A | * | 8/1998 | Drenth | 403/343 |
| 5,924,500 | A | * | 7/1999 | Puttmann | 175/61 |
| 6,196,598 | B1 | * | 3/2001 | Yao | 285/333 |
| 6,394,190 | B2 | * | 5/2002 | Linden | 403/307 |

FOREIGN PATENT DOCUMENTS

| | | | | | |
|---|---|---|---|---|---|
| DE | 1190887 | | | 5/1964 | |
| EP | 0032265 | A1 | * | 7/1981 | E21B/17/043 |
| GB | 2220460 | A | * | 1/1990 | E21B/17/042 |
| SE | 181171 | | | 10/1962 | |
| SU | 1810472 | A1 | * | 4/1993 | E21B/17/02 |

* cited by examiner

*Primary Examiner*—David Bagnell
*Assistant Examiner*—Jennifer H Gay
(74) *Attorney, Agent, or Firm*—Mark P. Stone

(57) ABSTRACT

A thread coupling for a drill string for percussive drilling has a male thread (5) and a cooperating female thread (4). The male thread is arranged on a first drill string element (3) having a first impact surface (6). The female thread is arranged on a second drill string element (2) having a second impact surface (7). The male and female threads are conical, and the crests (8) of the male thread (5) have a radius of curvature more than thirty degrees of the pitch of the thread.

4 Claims, 1 Drawing Sheet

THREAD COUPLING FOR A DRILL STRING FOR PERCUSSIVE ROCK DRILLING

BACKGROUND OF THE INVENTION

The present invention relates to a thread coupling for a drill string for percussive rock drilling.

In previously known thread couplings for percussive rock drilling one sometimes obtains breakage of the drill rod adjacent to the drill bit and on the skirt of the drill bit adjacent to the inner end of the thread of the drill bit. These breakages occur in particular when the collaring conditions are bad. The cause of these breakages is that the drill rod adjacent to its end surface in contact with a bottom impact surface on the drill bit is prestressed by the deformations occuring at the shock wave passage through the thread coupling in combination with the applied torque. A corresponding prestressing is obtained in the skirt of the drill bit.

SUMMARY OF THE INVENTION

The present invention, which is defined in the subsequent claim, aims at achieving a thread coupling which avoids these breakages through forming the thread coupling such that the material thickness becomes optimal at those parts on drill rod and drill bit which are most sensitive to breakage. This is achieved by means of a combination of conical threads and a well rounded crest of the threads. It has turned out to be advantageous to have a radius of curvature at the crest of the thread on the male thread which is at least 30% of the pitch of the thread. The conical thread form means that the prestressing of the thread is moved away from the contact surface between the end surface of the drill rod and the bottom impact surface. This effect is achieved because the pitch angle of the thread is larger at smaller thread diameter than at larger thread diameter, constant pitch

BRIEF DESCRIPTION OF THE DRAWINGS

An embodiment of the invention is described below with reference to the accompanying drawing in which.

DESCRIPTION OF THE BEST MODES FOR CARRYING OUT THE INVENTION

Figure 1:
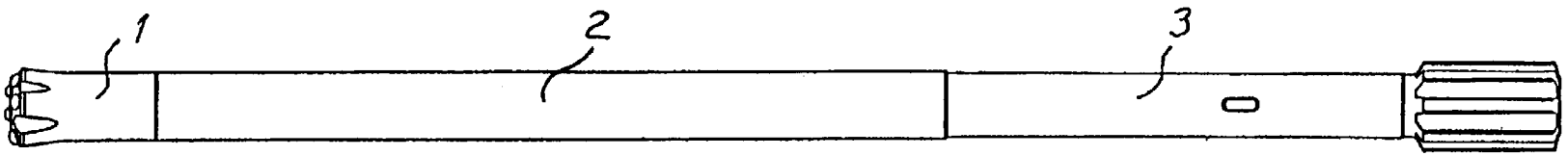
FIG. 1 shows a drill string with a thread coupling according to the invention.
Figure 2:
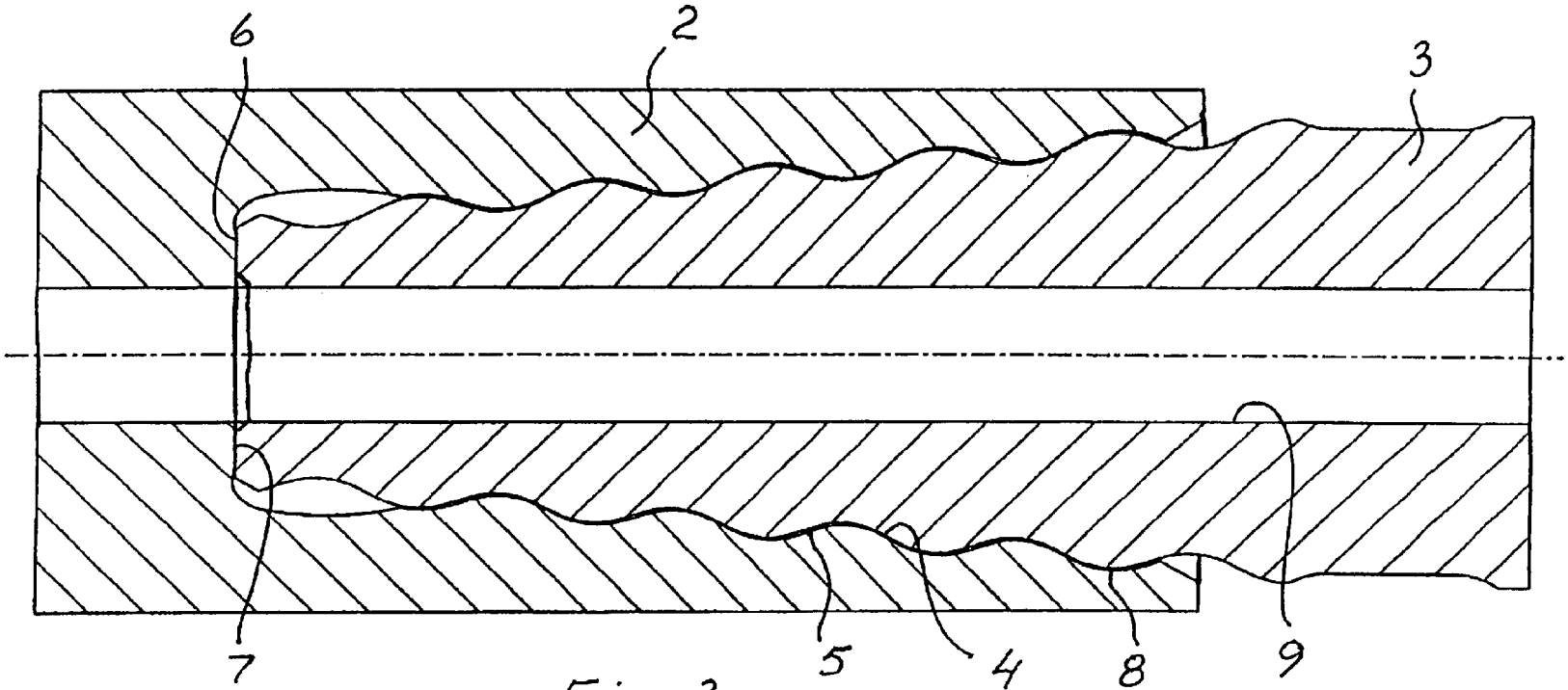
FIG. 2 is a section through a thread coupling according to the invention.

The drill string shown in the drawing comprises a drill bit 1, a drill rod 2 and a shank adapter 3. Instead of a drill rod as shown one can have several. Drill bit, drill rod and shank adapter are drill string elements. The thread coupling shown in the drawing comprises a male thread 5 arranged on a fast drill string element 3 and a female thread 4 arranged on a second drill string element 2. The first drill string element 3 is provided with a first impact surface 6. The second drill string element 2 is provided with a second impact surface 7. In the shown example contact is obtained between the impact surfaces 6,7 at the bottom of the female thread. One can alternatively form the drill string element such that one obtains contact at the outer end of the female thread. In this case the drill string element with the male thread is provided with an impact surface at the end of the male thread which is farthest away from the end of the drill string element. The drill string elements are provided with a central flushing channel 9. The male thread 5 and the female thread 4 are conical with constant pitch. It has turned out to be advantageous to make the thread with a cone angle which is smaller than 20°. This means that the pitch angle of the threads increases when the diameter decreases. Through this the largest load on the threads is moved away from the area where known technique has had a tendency to give thread breakage. Since the crests 8 of the male threads 5 have been given a radius of curvature which is more than 30% of the pitch of the thread good transfer of shock wave energy is obtained without overloading of the thread coupling.

What is claimed is:

1. Thread coupling for a drill string for percussive rock drilling comprising a male thread (5) and a female thread (4) cooperating therewith, said male thread being arranged on a first drill string element (3) and said female thread being arranged on a second drill string element (2), that said first drill string element (3) has a first impact surface (6) and that said second drill string element (2) has a second impact surface (7), said first and second impact surfaces being arranged to abut against each other, characterized in that said male thread (5) and said female thread (4) are conical and that the crests (8) of said male thread (5) have a radius of curvature which is larger than 30% of the pitch of the thread.

2. The thread coupling as claimed in claim 1 wherein the angle of the cone defined by the male thread (5) and the female thread (4) is less than 20°.

3. The thread coupling as claimed in claim 2, wherein the angle of the cone defined by the male thread (5) and the female thread (4) is between 2°–5°.

4. The thread coupling as claimed in claim 3, wherein the angle of the cone defined by the male thread (5) and the female thread (4) is 3°.

* * * * *